US009046240B2

(12) United States Patent
Roest

(10) Patent No.: US 9,046,240 B2
(45) Date of Patent: Jun. 2, 2015

(54) SOLAR SIMULATOR

(75) Inventor: Stefanus Johannes Maria Roest, Rotterdam (NL)

(73) Assignee: ETERNAL SUN GROUP B.V., Delft (NL)

( * ) Notice: Subject to any disclaimer, the term of this patent is extended or adjusted under 35 U.S.C. 154(b) by 12 days.

(21) Appl. No.: 13/978,880

(22) PCT Filed: Dec. 5, 2011

(86) PCT No.: PCT/NL2011/050834

§ 371 (c)(1),
(2), (4) Date: Oct. 8, 2013

(87) PCT Pub. No.: WO2012/096565

PCT Pub. Date: Jul. 19, 2012

(65) Prior Publication Data

US 2014/0022756 A1 Jan. 23, 2014

(30) Foreign Application Priority Data

Jan. 10, 2011 (NL) ..... 2005977

(51) Int. Cl.

| | |
|---|---|
| ***F21V 9/02*** | (2006.01) |
| ***F21S 8/00*** | (2006.01) |
| ***H05B 39/04*** | (2006.01) |
| ***H05B 41/392*** | (2006.01) |
| ***F21V 29/00*** | (2006.01) |
| ***F21V 9/04*** | (2006.01) |

(52) U.S. Cl.

CPC . *F21V 9/02* (2013.01); *F21S 8/006* (2013.01); *H05B 39/04* (2013.01); *H05B 41/392* (2013.01); *F21V 29/002* (2013.01); *F21V 9/04* (2013.01)

(58) Field of Classification Search

CPC .... H05B 39/04; H05B 41/392; F21V 29/002; F21V 9/04; F21V 9/02

See application file for complete search history.

(56) References Cited

U.S. PATENT DOCUMENTS

| | | | | |
|---|---|---|---|---|
| 3,202,811 | A | 8/1965 | Hall | |
| 3,870,873 | A | 3/1975 | Mallory | |
| 4,641,227 | A | 2/1987 | Kusuhara | |
| 5,217,285 | A | 6/1993 | Sopori | |
| 5,623,149 | A | 4/1997 | Kilmer | |
| 5,820,253 | A * | 10/1998 | Scholz | 362/267 |
| 2004/0039380 | A1 * | 2/2004 | Foldes | 606/9 |
| 2006/0176694 | A1 * | 8/2006 | Lee et al. | 362/253 |

OTHER PUBLICATIONS

Granek, F. et al., "Advanced System for Calibration and Characterization of Solar Cells", Opto-Electronics Review, 12 No. 1, 2004, 57-67.

Bisallion, J.C. et al., "Non-Traditional Light Sources for Solar Cell and Module Testing", Photovoltic Specialist Conference, 2000, Sep. 15, 2000, 1498-1501.

(Continued)

*Primary Examiner* — Donald Raleigh

(74) *Attorney, Agent, or Firm* — Jeffrey D. Myers; Peacock Myers, P.C.

(57) ABSTRACT

Solar simulator comprising at least at least one high-intensity discharge (HID) lamp type, and at least one halogen lamp type, which lamps are applied simultaneously and are provided with infrared filter means to provide a mixture of light approximating radiated sunlight, wherein the infrared filter means are embodied as heat reflective foil mounted on a transparent substrate. The heat reflective foil is preferably provided with a repetitive pattern of perforations.

14 Claims, 2 Drawing Sheets

(56) References Cited

OTHER PUBLICATIONS

Ma, Quan-Bao et al., "Highly Infrared Reflective Behavior of Transparent Conductive ZnO:Ga Films Synthesized by DC Reactive Magnetron Sputtering", ChemPhysChem, vol. 9, Issue 4, Mar. 14, 2008, 529-532.

Yoldas, Bulent E. et al., "Deposition of Optically Transparent IR Reflective Coatings on Glass", Applied Optics, vol. 23, Issue 20, 1984, 3638-3643.

* cited by examiner

SOLAR SIMULATOR

The invention relates to a solar simulator comprising at least at least one high-intensity discharge (HID) lamp type, and at least one halogen lamp type, which lamps are applied simultaneously and are provided with infrared filter means to provide a mixture of light approximating radiated sunlight.

Such a solar simulator is known from US2006/0176694.

From the prior art it is known that several types of lamps can be used as light sources within a solar simulator, notably high-intensity discharge (HID) lamps and halogen lamps.

A high-intensity discharge (HID) lamp is a type of electrical lamp which produces light by means of an electric arc between tungsten electrodes housed inside a translucent or transparent fused quartz or fused alumina arc tube. Examples of HID lamps include: mercury vapor lamps, metal halide (MH)lamps, ceramic MH lamps, sodium vapor lamps, Xenon short arc lamps. HID lamps are typically used when high light intensities over large areas are required, and when energy efficiency and/or accurate colour rendering are desired.

The most common type of lamp both for continuous and flashed solar simulators are Xenon arc lamps. These lamps offer high intensities and an unfiltered spectrum which matches reasonably well to sunlight (AM1.5 spectrum). However, the Xenon spectrum is also characterized by many undesirable sharp atomic transitional peaks, making the spectrum less desirable for some spectrally-sensitive applications. Xenon arc lamps are also relatively unstable, prone to phenomena such as plasma oscillation and thermal runaway. Therefore these lamps require very sophisticated electronic control gear to be suitable for solar simulation. Xenon arc lamps can be designed for low powers or up to several kilowatts, providing the means for small- or large-area illumination, and low to high intensities.

It is also known to apply quartz tungsten halogen lamps in solar simulators. Halogen lamps offer spectra which very closely match black body radiation, although typically with a lower color temperature, and thus a very different light spectrum, than the sun.

According to the invention the solar simulator according to the preamble is characterized in that the infrared filter means are embodied as a heat reflective foil mounted on a transparent substrate. It is found that the spectrum of the solar simulator notably benefits from the application of this heat reflective foil.

It is found particularly useful that the heat reflective foil is provided with a repetitive pattern of perforations. The improvement applies in particular to the near infrared region, starting at a wavelength of some 900 nm.

The solar simulator of the invention has the advantage that it can be implemented at very low costs by combining commonly available, low-tech components; it is possible to implement the solar simulator of the invention at less than half the costs of a solar simulator according to the prior art. Moreover within the terms of the IEC standard 60904-9 the solar simulator of the invention can be rated without much effort at CAA for spectral match, non-uniformity of irradiance in the test plane and temporal instability, respectively. This is quite impressive when one realizes that this result, particularly with regard to spectral match, is achieved with a first prototype not yet tuned to its optimal performance.

It is preferred that there is a plurality of high-intensity discharge lamps and a plurality of halogen lamps that are applied in an array such that any lamp of the high-intensity discharge lamp type has a lamp or lamps of the halogen lamp type as a neighbor, and that any lamp of the halogen lamp type has a lamp or lamps of the high-intensity discharge lamp type as a neighbor. This promotes adequate mixing of light of both types of lamps, and provides a light spectrum of the solar simulator that has a close match with the spectrum of the sun, i.e. the Air Mass (AM) 1.5 spectrum.

It is to this end particularly preferred that a plurality of high-intensity discharge lamps and a plurality of halogen lamps are placed in an array comprising rows of lamps of both the high-intensity discharge lamp type and the halogen lamp type, whereby in each row of the array the lamps of said types are alternating. Best results are achieved when also the lamps at neighboring positions in adjacent rows are of alternating type.

A further preferred embodiment has the feature that the lamps are placed in a box having sidewalls that are provided with or that are embodied as mirrors, whereby the box has an open end between the sidewalls through which the light of the lamps is radiated. This feature contributes to the uniformity of radiation of the solar simulator and reduces the required amount of lamps.

Still a further preferred feature is that at least the lamps of the halogen lamp type are provided with a filter to reduce radiation in their spectrum of radiation above a wavelength of 1600 nm. By applying such a filter the spectral match of the solar simulator can be improved. A AAA-rating according to IEC standard 60904-9 is easily obtainable.

The spectral match and light uniformity of the solar system are further promoted by the feature that the lamps from the halogen lamp type are controlled to tune their relative power and radiated spectrum with respect to the power and radiated spectrum of the high-intensity discharge type lamps.

In the following the invention will be further elucidated with reference to the drawing representing a prototype of a solar simulator according to the invention.

In the drawing.

Whenever in the figures the same reference numerals are applied, these numerals refer to the same parts.

Figure 1:
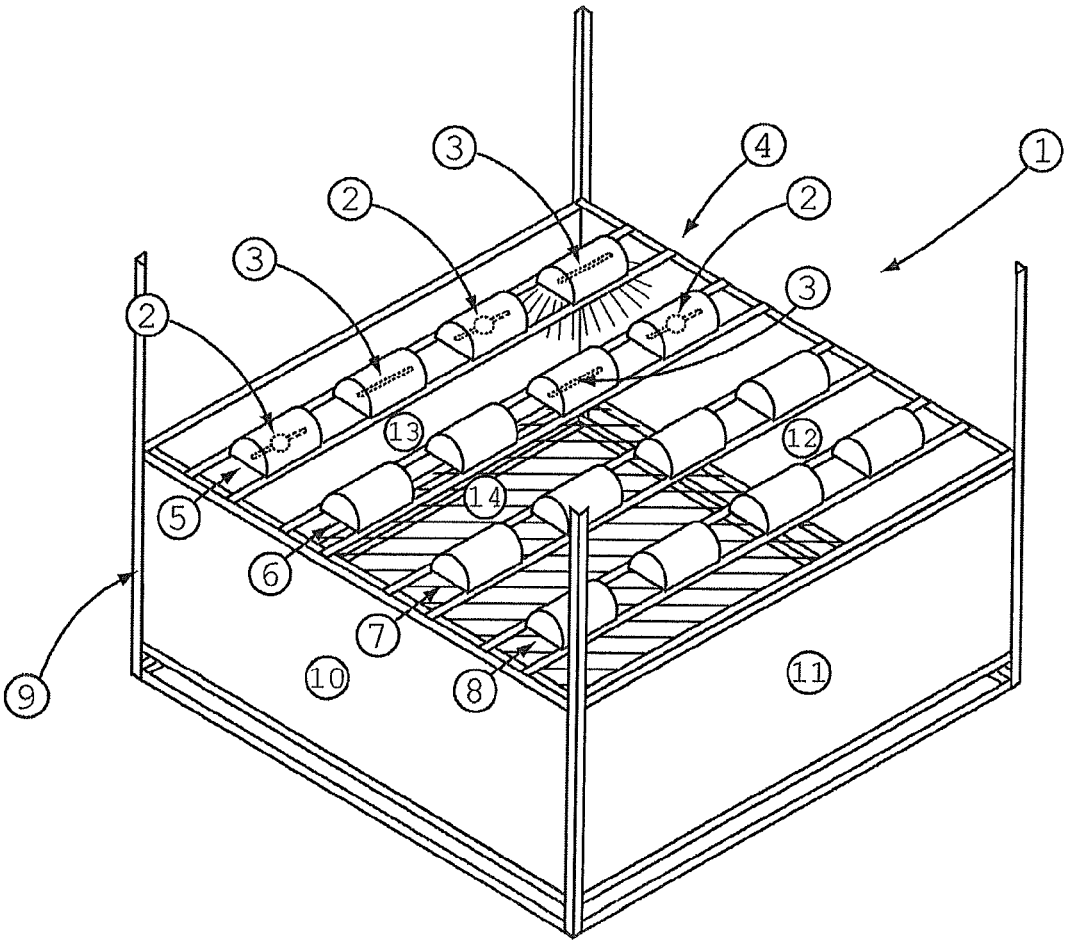
FIG. 1 shows an isometric view of the solar simulator of the invention.

With reference first to FIG. 1, the solar simulator of the invention is denoted with reference 1. The solar simulator 1 of the invention comprises both lamps of the high-intensity discharge lamp type 2 and the halogen lamp type 3, and the lamps from said types 2, 3 are applied simultaneously to provide a mixture of light derived from the high-intensity discharge lamp or lamps 2 and the halogen lamp or lamps 3.

As FIG. 1 shows there is a plurality of high-intensity discharge lamps 2 and a plurality of halogen lamps 3 that are applied in an array such that any lamp of the high-intensity discharge lamp type 2 has a lamp or lamps of the halogen lamp type 3 as a neighbor, and that any lamp of the halogen lamp type 3 has a lamp or lamps of the high-intensity discharge lamp type 2 as a neighbor.

Figure 2:
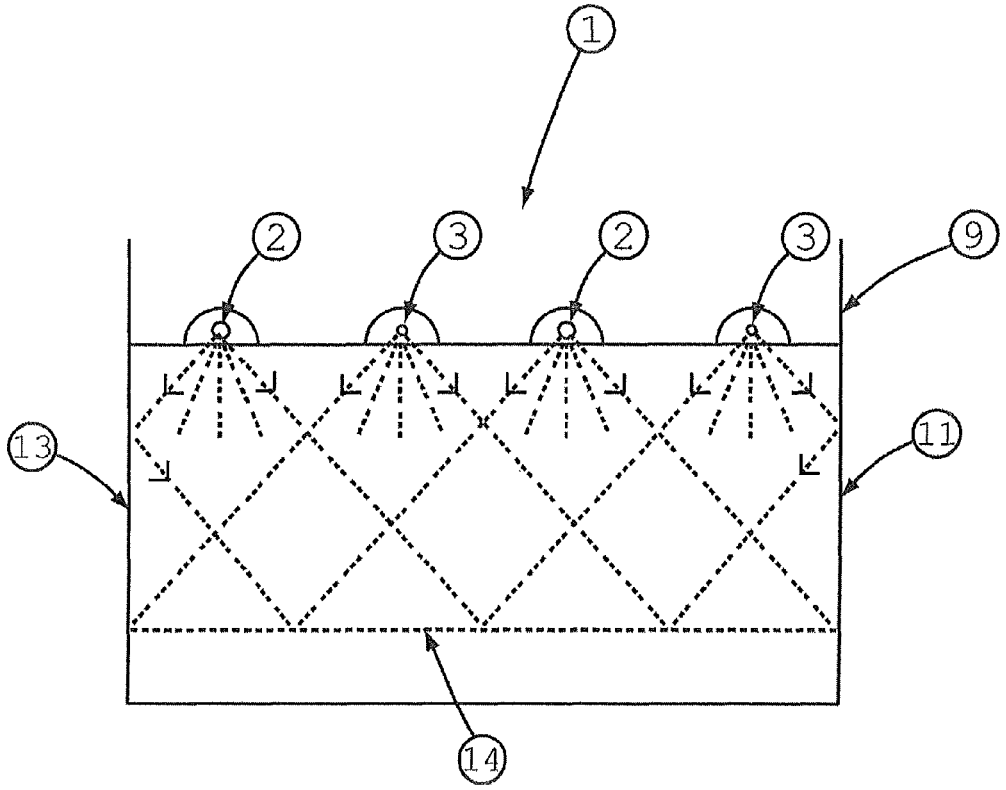
FIG. 2 shows a side view of the solar simulator according to FIG. 1.

Conveniently the plurality of high-intensity discharge lamps 2 and the plurality of halogen lamps 3 are placed in an array 4 comprising rows 5, 6, 7, 8 of lamps of both the high-intensity discharge lamp type 2 and the halogen lamp type 3, whereby in each row 5, 6, 7, 8 of the array 4 the lamps of said types 2, 3 are alternating. The lamps at a neighboring position in an adjacent row are preferably also of alternating type, which is clearly shown in FIG. 2. The number of rows as well as the number of lamps in any row can be selected at any value to meet the requirements of a particular situation.

FIG. 1 shows that the lamps of the solar simulator 1 are placed in a box 9 having sidewalls 10, 11, 12, 13 that are in this example embodied as mirrors. The box 9 has infrared filter means 14 embodied as a heat reflective foil mounted on a transparent substrate, which is placed between the sidewalls 10, 11, 12, 13 and towards which the light of the lamps is radiated. The heat reflective foil is provided with a repetitive pattern of perforations, which can be better seen in FIG. 2. At the location of the substrate of the filter means 14 that is opposite from the lamps a test object can be placed.

Although not essential it is further remarked that at least the lamps of the halogen lamp type 3 may be provided with a filter to reduce radiation in their spectrum of radiation above a wavelength of 1600 nm. This is not shown in the figures but this can be easily implemented by arranging for instance a polycarbonate filter between the halogen lamps 3 and the filter means 14. Beneficially further the lamps from the halogen lamp type 3 are controlled to tune their relative power and radiated spectrum with reference to the power and radiated spectrum of the lamps of the high-intensity discharge lamp type 2, so as to arrive at a uniform light distribution and optimal match with the solar spectrum.

What is claimed is:

1. Solar simulator comprising at least at least one high-intensity discharge (HID) lamp type and at least one halogen lamp type, which lamps are applied simultaneously and are provided with an infrared filter to provide a mixture of light approximating radiated sunlight, wherein the infrared filter is embodied as heat reflective foil mounted on a transparent substrate, and wherein a plurality of high-intensity discharge lamps and a plurality of halogen lamps are placed in an array comprising rows of lamps of both the high-intensity discharge lamp type and the halogen lamp type, whereby in each row of the array the lamps of said types are alternating.

2. Solar simulator according to claim 1, wherein the heat reflective foil is provided with a repetitive pattern of perforations.

3. Solar simulator according to claim 1, wherein there is a plurality of high-intensity discharge lamps and a plurality of halogen lamps that are applied in an array such that any lamp of the high-intensity discharge lamp type has a lamp or lamps of the halogen lamp type as a neighbor, and that any lamp of the halogen lamp type has a lamp or lamps of the high-intensity discharge lamp type as a neighbor.

4. Solar simulator according to claim 1, wherein the lamps at neighboring positions in adjacent rows are of an alternating type.

5. Solar simulator according to claim 1, wherein the lamps are placed in a box having sidewalls that are provided with or are embodied as mirrors, and which box has an open end between the sidewalls towards which the light of the lamps is radiated.

6. Solar simulator according to claim 1, wherein at least the lamps of the halogen lamp type are provided with a filter to reduce radiation in their spectrum of radiation above a wavelength of 1600 nm.

7. Solar simulator according to claim 1, wherein the lamps from the halogen lamp type are controlled to tune their relative power and radiated spectrum with reference to the power and radiated spectrum of the lamps of the high-intensity discharge lamp type.

8. Solar simulator comprising at least at least one high-intensity discharge (HID) lamp type and at least one halogen lamp type, which lamps are applied simultaneously and are provided with an infrared filter to provide a mixture of light approximating radiated sunlight, wherein the infrared filter is embodied as heat reflective foil mounted on a transparent substrate, and wherein the lamps are placed in a box having sidewalls that are provided with or are embodied as mirrors, and which box has an open end between the sidewalls towards which the light of the lamps is radiated.

9. Solar simulator according to claim 8, wherein the heat reflective foil is provided with a repetitive pattern of perforations.

10. Solar simulator according to claim 8, wherein there is a plurality of high-intensity discharge lamps and a plurality of halogen lamps that are applied in an array such that any lamp of the high-intensity discharge lamp type has a lamp or lamps of the halogen lamp type as a neighbor, and that any lamp of the halogen lamp type has a lamp or lamps of the high-intensity discharge lamp type as a neighbor.

11. Solar simulator according to claim 8, wherein a plurality of high-intensity discharge lamps and a plurality of halogen lamps are placed in an array comprising rows of lamps of both the high-intensity discharge lamp type and the halogen lamp type, whereby in each row of the array the lamps of said types are alternating.

12. Solar simulator according to claim 11, wherein the lamps at neighboring positions in adjacent rows are of an alternating type.

13. Solar simulator according to claim 8, wherein at least the lamps of the halogen lamp type are provided with a filter to reduce radiation in their spectrum of radiation above a wavelength of 1600 nm.

14. Solar simulator according to claim 8, wherein the lamps from the halogen lamp type are controlled to tune their relative power and radiated spectrum with reference to the power and radiated spectrum of the lamps of the high-intensity discharge lamp type.

* * * * *